US008337634B2

(12) United States Patent
Iijima et al.

(10) Patent No.: US 8,337,634 B2
(45) Date of Patent: Dec. 25, 2012

(54) METHODS AND REMOVERS FOR REMOVING ANODIZED FILMS

(75) Inventors: Katsuyuki Iijima, Kobe (JP); Tetsuo Suzuki, Kobe (JP)

(73) Assignee: Kobe Steel, Ltd., Kobe-shi (JP)

( * ) Notice: Subject to any disclaimer, the term of this patent is extended or adjusted under 35 U.S.C. 154(b) by 517 days.

(21) Appl. No.: 12/708,968

(22) Filed: Feb. 19, 2010

(65) Prior Publication Data

US 2010/0147802 A1 Jun. 17, 2010

Related U.S. Application Data

(62) Division of application No. 11/424,369, filed on Jun. 15, 2006, now Pat. No. 7,704,936.

(30) Foreign Application Priority Data

Jul. 15, 2005 (JP) ..... 2005-207585

(51) Int. Cl.
*C23F 1/02* (2006.01)
*C11D 7/06* (2006.01)

(52) U.S. Cl. ..... 134/41; 510/201; 510/202; 510/203

(58) Field of Classification Search ..... 510/201, 510/202, 203; 134/41
See application file for complete search history.

(56) References Cited

U.S. PATENT DOCUMENTS

| | | | | |
|---|---|---|---|---|
| 3,969,199 | A | 7/1976 | Berdan et al. | |
| 5,141,778 | A | 8/1992 | Yarkosky et al. | |
| 5,182,006 | A | 1/1993 | Haydu et al. | |
| 5,245,847 | A | 9/1993 | Bando et al. | |
| 6,162,343 | A | 12/2000 | Takami et al. | |
| 7,704,671 | B2 * | 4/2010 | Yamasaki et al. | 430/270.1 |
| 7,704,936 | B2 * | 4/2010 | Iijima et al. | 510/201 |
| 2002/0172889 | A1 * | 11/2002 | Oohashi | 430/273.1 |
| 2002/0177654 | A1 | 11/2002 | Erdem et al. | |
| 2004/0173467 | A1 | 9/2004 | Joshi et al. | |
| 2005/0008788 | A1 | 1/2005 | Joshi et al. | |
| 2005/0194574 | A1 * | 9/2005 | Yamamuro et al. | 252/500 |
| 2005/0221226 | A1 * | 10/2005 | Yamasaki | 430/270.1 |
| 2007/0012338 | A1 * | 1/2007 | Iijima et al. | 134/2 |
| 2008/0210342 | A1 * | 9/2008 | Iijima et al. | 148/272 |
| 2010/0147802 | A1 * | 6/2010 | Iijima et al. | 216/101 |

FOREIGN PATENT DOCUMENTS

| | | |
|---|---|---|
| JP | 61-90777 | 5/1986 |
| JP | 2004-211128 | 7/2004 |
| JP | 2004-323913 | 11/2004 |

OTHER PUBLICATIONS

Office Action issued May 24, 2011, in Japanese Patent Application No. 2006-180457 (with English-language translation).

* cited by examiner

*Primary Examiner* — Gregory Webb
(74) *Attorney, Agent, or Firm* — Oblon, Spivak, McClelland, Maier & Neustadt, L.L.P.

(57) ABSTRACT

A remover contains an alkaline component, a bivalent zinc ion, a ferric ion, a chelating agent, and a nitrate ion. By using this remover, an anodized film can be selectively removed from an aluminum or aluminum-alloy member.

19 Claims, 2 Drawing Sheets

METHODS AND REMOVERS FOR REMOVING ANODIZED FILMS

BACKGROUND OF THE INVENTION

1. Field of the Invention

The present invention relates to removers for selectively removing anodized films formed as a result of anodization of aluminum or aluminum-alloy members. It also relates to methods for removing anodized films using the removers.

2. Description of the Related Art

Some aluminum or aluminum-alloy members are anodized in order to harden their surfaces or to impart corrosion resistance to the surfaces. When anodized films formed by anodization must be partially removed or be retreated, they are removed typically by chemical etching or shot blasting.

Examples of removers (etchants) used in chemical etching are (1) a mixture of phosphoric acid and chromic acid, (2) an aqueous sodium hydroxide solution, (3) a mixture of sulfuric acid and hydrofluoric acid, (4) a mixture of sulfuric acid and potassium fluoride, and (5) a mixture of nitric acid and hydrofluoric acid ("ARUMINIUMU HYAKKAJITEN (Encyclopedia of Aluminum)", edited by KEIKINZOKU KYOKAI (Japanese Association of Light Metals)). Japanese Unexamined Patent Application Publication (JP-A) No. 2004-211128 discloses a method for removing oxide films by etching with a phosphoric acid/chromic acid solution, a sodium hydroxide solution, and/or a potassium hydroxide solution in a method for recycling aluminum parts for semiconductor equipment. JP-A No. 61-90777 discloses a method for removing anodized aluminum films not by a chemical process but by shot blasting, in consideration that conventional sulfuric acid treatment solutions corrode or are harmful to underlying metals.

The mixture of phosphoric acid and chromic acid must be kept at high temperatures of 95° C. to 100° C. for efficiently dissolving anodized films, and it requires much efforts and facilities to treat the waste liquid and effluent thereof, because the mixture contains environmentally harmful chromium, although the mixture does not damage aluminum or aluminum-alloy members as underlying metals. The aqueous sodium hydroxide solution dissolves underlying aluminum or aluminum alloys, which causes significant dimensional changes of members upon removal of anodized films, although the solution can efficiently dissolve and remove anodized films at temperatures of around room temperature to about 60° C. The mixtures of sulfuric acid with hydrofluoric acid, of sulfuric acid with potassium fluoride, and of nitric acid with hydrofluoric acid dissolve underlying aluminum or aluminum alloys, which causes significant dimensional changes of members upon removal of the anodized films as in the aqueous sodium hydroxide solution, although they can efficiently dissolve and remove anodized films at around room temperature.

Such methods for removing anodized films in which underlying aluminum or aluminum alloys are dissolved are not desirable for removing anodized films of members which require high dimensional accuracy as in semiconductor equipment. Mechanical methods for removing anodized films, such as shot blasting, cannot be applied to members having complicated shapes, although they can be applied to members having simple shapes, such as plates and rods.

SUMMARY OF THE INVENTION

Under these circumstances, an object of the present invention is to selectively remove anodized films from anodized aluminum or aluminum-alloy members.

To achieve the object, the present invention provides a remover for removing an anodized film of an aluminum or aluminum-alloy member, containing an alkaline component, a bivalent zinc ion, a ferric ion, a chelating agent, and a nitrate ion. The anodized film can be selectively removed while preventing the dissolution of the underlying aluminum or aluminum alloy, by incorporating to the remover both an alkaline component for dissolving the anodized film, and a bivalent zinc ion for forming another film on the surface of the underlying aluminum or aluminum-alloy member.

The remover contains the nitrate ion so as to accelerate the formation of a homogeneous zinc film. It contains the ferric ion so as to prevent the zinc film from depositing excessively. The chelating agent acts to chelate the ferric ion so as to prevent the ferric ion from forming a water-insoluble hydroxide.

The remover preferably contains 10 g/l to 100 g/l of the alkaline component in terms of hydroxide ion concentration, 2 g/l to 20 g/l of the bivalent zinc ion, 0.1 g/l to 1 g/l of the ferric ion, 20 g/l to 200 g/l of the chelating agent, and 0.3 g/l to 3 g/l of the nitrate ion. The remover can further contain 500 ppm to 5,000 ppm of a secondary amine.

The present invention further provides a method for removing an anodized film, including the steps of immersing an anodized aluminum or aluminum-alloy member in a remover containing a component for dissolving an anodized film, and a component for forming another film on the surface of the aluminum or aluminum alloy to thereby remove the anodized film from the member and to form another film on the member, and removing the another film. Specifically, the method preferably includes the steps of immersing an anodized aluminum or aluminum-alloy member in the remover to thereby remove an anodized film and to deposit a zinc film on the surface of the aluminum or aluminum-alloy member, and subsequently immersing the member in a 100 g/l to 360 g/l aqueous nitric acid solution containing 2 g/l to 24 g/l of a fluorine ion, to thereby remove the zinc film.

The present invention can selectively remove anodized films from anodized aluminum or aluminum-alloy members. The present invention is therefore advantageously applied typically to removal of anodized films from aluminum or aluminum alloy parts used typically for semiconductor equipment, which require high dimensional accuracy.

Further objects, features and advantages of the present invention will become apparent from the following description of the preferred embodiments with reference to the attached drawings.

DESCRIPTION OF THE PREFERRED EMBODIMENTS

Figure 1:
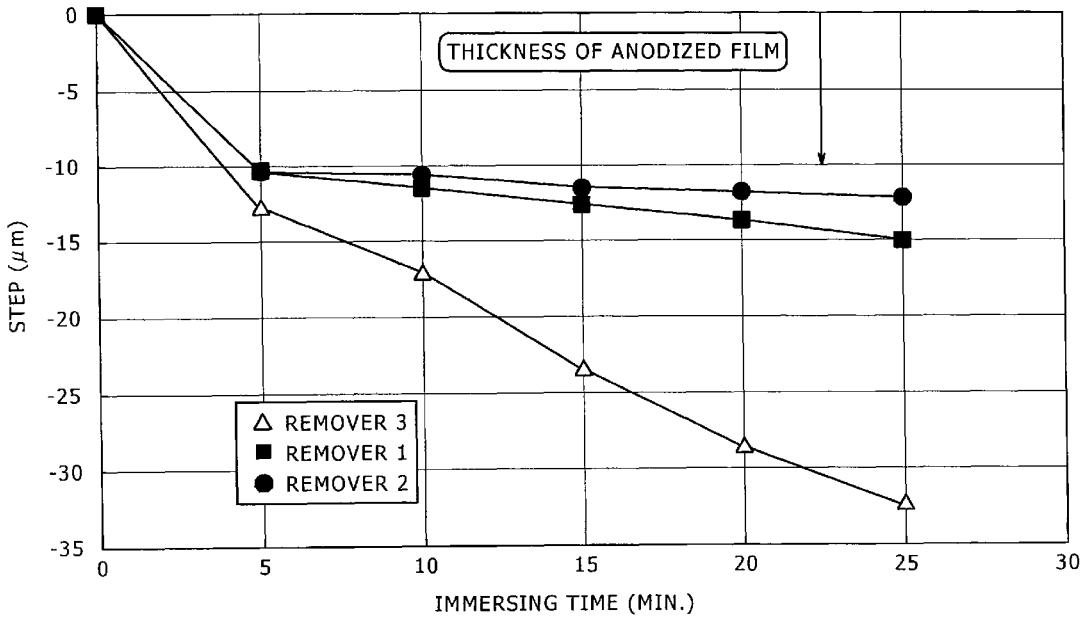
FIG. 1 is a graph longitudinally showing the removal of anodized films.

The remover for removing an anodized film from an aluminum or aluminum-alloy member according to the present invention comprises an alkaline component, a bivalent zinc ion, a ferric ion (trivalent iron ion), a chelating agent, and a nitrate ion.

Initially, the alkaline component will be described. The alkaline component is a component for removing an anodized film and is not specifically limited, as long as it is a substance that can be dissolved in water to form a hydroxide ion. The alkaline component preferably removes the anodized film as a result of dissolution. The remover has a concentration of the alkaline component of preferably 10 g/l or more and 100 g/l or less, and more preferably 25 g/l or more and 75 g/l or less in terms of hydroxide ion concentration. The anodized film cannot be significantly efficiently dissolved if the hydroxide ion concentration is less than 10 g/l. In contrast, if the hydroxide ion concentration exceeds 100 g/l, the reaction rate between the alkaline component and the anodized film becomes excessively high, the reaction may be difficult to control, the dissolution rate of the underlying aluminum or aluminum alloy may become excessively high, and the control of dimensional change before and after removal of the film may become difficult. The alkaline component is preferably a strongly alkaline component such as sodium hydroxide or potassium hydroxide, because these strongly alkaline components can efficiently dissolve and remove the anodized film at temperatures from room temperature to about 40° C.

The bivalent zinc ion in the remover deposits and thereby forms a film (zinc film) on the exposed surface of the aluminum or aluminum alloy after removal of the anodized film. The zinc film acts to prevent the underlying aluminum or aluminum alloy from being dissolved by the action of the alkaline component. The bivalent zinc ion is believed to be dissolved in the form of zincic acid [$(Zn(OH)_4)^{2-}$] in a high-concentration aqueous alkaline solution. The concentration of the bivalent zinc ion is preferably 2 g/l or more and 20 g/l or less, and more preferably 4 g/l or more and 10 g/l or less. If the bivalent zinc ion concentration is less than 2 g/l, a zinc film may not be efficiently formed on the surface of the aluminum or aluminum alloy after removal of the anodized film. In contrast, if it exceeds 20 g/l, a zinc film may deposit at an excessively high rate to be porous, and the function of protecting the aluminum or aluminum-alloy from the alkaline component may be reduced. The remover can comprise the zinc ion in the form typically of zinc chloride, zinc oxide or zinc sulfate.

Zinc deposits on the surface of the aluminum or aluminum alloy as a result of an electrochemical reaction. A ferric ion ($Fe^{3+}$) is effective to prevent excessive deposition of zinc. However, a chelating agent must be added in combination so as to prevent an insoluble hydroxide from forming, because the ferric ion forms an insoluble hydroxide in a strongly alkaline aqueous solution. A chelating agent having a carboxyl group is preferably used in the present invention. The optimum chelating agent herein is a hydroxycarboxylic acid having both a carboxyl group and a hydroxyl group in the molecule, such as tartaric acid, citric acid, gluconic acid, malic acid, or a metal salt thereof.

The concentration of the ferric ion is preferably 0.1 g/l to 1 g/l. If the concentration is less than 0.1 g/l, excessive deposition of zinc may not be sufficiently prevented. If it exceeds 1 g/l, zinc may insufficiently deposit to thereby fail to form a homogenous zinc film.

The concentration of the chelating agent can be any one, as long as the formation of iron hydroxide is sufficiently prevented, and is preferably such that the number of moles of a carboxyl group of the chelating agent is 10-folds to 100-folds that of the iron ion. If the number of moles of the carboxyl group is less than 10-folds that of the iron ion, the formation of the insoluble hydroxide of the ferric ion may not be sufficiently prevented. Since the 100-folds concentration may be enough to prevent the formation, the 100-folds concentration or less is economically preferable.

The nitrate ion ($NO^{3-}$) for use in the present invention is effective to form a homogeneous zinc film. The remover contains the nitrate ion preferably in the form of potassium nitrate or sodium nitrate. The concentration of the nitrate ion is preferably 0.3 g/l to 3 g/l. If the concentration is less than 0.3 g/l, excessive deposition of zinc may not be effectively prevented. In contrast, if it exceeds 3 g/l, zinc may insufficiently deposit to thereby fail to form a zinc film sufficiently.

The remover preferably further comprise 500 ppm to 5,000 ppm of a secondary amine. This enables easier deposition of a dense or compact zinc film upon deposition of zinc on the exposed surface of the underlying aluminum or aluminum alloy after removal of the anodized film. Examples of the secondary amine are dibutylamine, diethylamine, and diethanolamine.

When the anodized film is removed by using the remover, zinc deposits and thereby forms a film on the surface of the aluminum or aluminum-alloy member. Consequently, the deposited zinc film must be removed in an aftertreatment. The zinc film can be easily removed by immersing the member in an aqueous nitric acid solution. The aqueous nitric acid solution can selectively remove the zinc film, because it dissolves and thereby removes zinc but does not substantially dissolve the aluminum or aluminum alloy. The aqueous nitric acid solution preferably further comprises a trace amount of a fluorine ion. The resulting solution can further effectively remove the zinc film, even though it slightly dissolves the underlying aluminum or aluminum alloy. The concentration of the fluorine ion is preferably 2 g/l to 24 g/l. The advantages of addition of fluorine ion may not be sufficient if the concentration is less than 2 g/l. In contrast, the underlying aluminum or aluminum alloy may be excessively dissolved, if the concentration exceeds 24 g/l. The fluorine ion is added preferably in the form of hydrofluoric acid, potassium fluoride, or sodium fluoride.

The anodized aluminum or aluminum-alloy member to which the present invention can be applied is not specifically limited but includes those used as parts constituting semiconductor equipment such as dry etching systems, chemical vapor deposition (CVD) systems, and sputtering systems. Specific examples of the member are chambers, exhaust gas dispersing plates, shower plates, electrode plates, and electrostatic chuck substrates. The aluminum alloy is not specifically limited and includes, for example, aluminum alloys of 1080, 1070, 1050, 1100, 1200, 1N00, 2014, 2017, 2024, 3003, 3203, 3004, 3005, 5005, 5052, 5652, 5154, 5254, 5454, 5082, 5182, 5083, 5086, 5N01, 6061, 6063, 7N01, and 7075 according to Japanese Industrial Standards (JIS) H 4000.

The underlying aluminum or aluminum alloy may have uneven color on its surface (hereinafter also referred to as "non-uniformities") in some rare cases when the anodized film is removed using the remover. The non-uniformities are not considered to be caused by residual anodized film or deposition of impurities, because such non-uniformities do not show a difference from surroundings in energy-dispersive X-ray (EDX) analysis. While detailed causes have not yet been clarified, the non-uniformities are probably caused by uneven surface roughness occurred in the removal (elimination) of the anodized film. For example, if a contaminant is attached on the surface of the member to be treated, a zinc film is prevented from forming at this portion, and the aluminum or aluminum alloy is not prevented from being dissolved by the alkaline component, and thereby the portion is etched in a different way and thereby shows a different surface roughness from surroundings, when the anodized film is removed, and the aluminum or aluminum alloy is exposed.

The surface roughness is preferably uniformized by bringing fine hard particles into collision with the surface of the member when the surface appearance of the member should be improved by eliminating the surfacial non-uniformities of the aluminum or aluminum-alloy member after removal of the anodized film.

The fine hard particles can be brought into collision with the surface of the aluminum or aluminum-alloy member by any procedure that does not excessively damage the surface of the member. Among such procedures, air blasting or shot blasting is preferably carried out. A material constituting the fine hard particles is not specifically limited, as long as it is harder than the aluminum or aluminum alloy to be treated. Examples thereof are silicon carbide, boron carbide, silica sand, alumina, and glass beads. The fine hard particles for use herein preferably have a maximum particle diameter of 130 μm or less and a particle diameter at 50% of accumulated height in volume/particle diameter distribution of 105 μm or less. Fine hard particles having a maximum particle diameter exceeding 130 μm may excessively damage the member. For example, WA (white aluminum abrasive) particles #240 to #8000 (Fujimi Incorporated) can be used as the fine hard particles.

When the fine hard particles are brought into collision with the member by air blasting, the air pressure is preferably within the range of 0.1 MPa to 1 MPa.

The aluminum or aluminum-alloy member after the collision with the fine hard particles preferably has such a surface roughness as follows. Specifically, arbitrary ten points of the surface of the member are photographed at a magnification of 1000 times using an ultra-deep color 3D profile measuring microscope VK-9500 (KEYENCE CORPORATION), and the arithmetical mean surface roughness (Ra) of the resulting photographs of all the points is determined using a software "Profile Measuring Application VK-H1A9" (KEYENCE CORPORATION) in accordance with the 2001-JIS specifications at a cutoff of λs of 2.5 μm and λc of 250 μm. In this procedure, the member preferably has a difference between the maximum and the minimum surface roughness in the ten points of 2.5 μm or less.

The fine hard particles attached to the surface of the aluminum and aluminum alloy member after the collision can be removed by etching the member in a solution of an agent generally usable for etching of aluminum. The fine hard particles can be removed, for example, by immersing the member in a 10 percent by weight aqueous sodium hydroxide solution heated at 50° C. for two minutes and then washing the members with water and immersing the member in a 20 percent by weight aqueous nitric acid solution at room temperature and then washing the members with water.

It is also effective to remove contaminants deposited on the surface of the aluminum or aluminum-alloy member in a pretreatment so as to eliminate non-uniformities of the aluminum or aluminum-alloy member after removal of the anodized film. For example, the contaminants may be removed from the surface of the anodized film by immersing the anodized aluminum or aluminum-alloy member in a chemical agent that does not substantially dissolve the anodized film. A solvent such as acetone or ethanol can be used when an easily-soluble organic matter such as sebum is deposited as the contaminants. An insoluble matter such as a resin, if deposited as contaminants, can be effectively removed by immersing the member in hydrogen peroxide, a mixture of hydrogen peroxide and aqueous sodium carbonate solution, or ozone water.

A mechanical treatment such as air blasting or shot blasting can be employed as a pretreatment in combination with the immersion in a chemical agent when part of contaminants remain even after the previous removal of contaminants from the anodized film, and the residual contaminants cause non-uniformities upon immersion of the member in the remover.

EXAMPLES

Test Example 1

An anodized film 10 μm thick was formed on a JIS 6063 aluminum alloy 20 mm wide, 60 mm long, and 4 mm thick using a sulfuric acid-containing treatment liquid, and the aluminum alloy was subjected to pore sealing and thereby yielded test pieces. The test pieces were subjected to the following peeling test. The surfaces of the test pieces were covered with an adhesive tape in a longitudinal direction from one end to 30 mm inside so as to prevent the contact with a remover. Five plies of the test pieces were immersed in the removers shown in Table 1, and each one ply was taken out from the remover five minutes, ten minutes, fifteen minutes, twenty minutes, and twenty-five minutes after the beginning of the immersion. The test pieces were then washed with water and were immersed in a 200 g/l aqueous nitric acid solution containing 5 g/l of a fluorine ion for one minute, followed by washing with water and drying. The adhesive tape was then removed, and a step between a portion which had been masked by the tape and a portion which had been brought in contact with the remover was determined using a stylus profilemeter. The results are shown in FIG. 1.

TABLE 1

| Component | Unit | Remover 1 | Remover 2 | Remover 3 |
|---|---|---|---|---|
| Sodium hydroxide | g/l | 150 | 150 | 150 |
| (Hydroxyl group concentration) | g/l | 63.8 | 63.8 | — |
| Zinc chloride | g/l | 15 | 15 | — |
| (Zinc ion concentration) | g/l | 7.2 | 7.2 | — |
| Ferric chloride hexahydrate | g/l | 2.5 | 2.5 | — |
| (Iron ion concentration) | g/l | 0.52 | 0.52 | — |
| Chelating agent* | g/l | 70 | 70 | — |
| Potassium nitrate | g/l | 2 | 2 | — |
| (Nitrate ion concentration) | g/l | 1.23 | 1.23 | — |
| Dibutylamine | ppm | — | 1000 | — |

Chelating agent*: Potassium sodium tartrate tetrahydrate. The number of moles of a carboxyl group of the 70 g/l of potassium sodium tartrate tetrahydrate is 53-folds that of the iron ion of the 2.5 g/l of ferric chloride hexahydrate.

FIG. 1 shows that the step becomes large with elapse of time when a conventional aqueous sodium hydroxide (NaOH) solution (Remover 3) is used, because the underlying aluminum alloy is dissolved even after the removal of the anodized film. In contrast, Removers 1 and 2 according to the present invention can retard the increase in size of the step. This is probably because, when the anodized film is removed and thereby the underlying aluminum alloy is exposed, a zinc film deposits on the surface of the exposed underlying aluminum alloy to thereby prevent the aluminum alloy from dissolving.

Test Example 2

A JIS 6061 aluminum alloy shower plate 270 mm in outer diameter and 5 mm in thickness having a large number of holes 0.5 mm in diameter was subjected to removal of an anodized film. The anodized film was formed overall the surface of the plate including inside walls of the holes.

The shower plate was immersed in each of Removers 2 and 3 in Table 1 at room temperature for twenty minutes, was then washed with water, and was immersed in a 200 g/l aqueous nitric acid solution containing 5 g/l of a fluorine ion for three minutes. The plate was further washed with water and dried, and the holes were observed under an optical microscope. The results are shown in FIGS. 2A, 2B, and 2C.

Figures 2A, 2B, 2C:
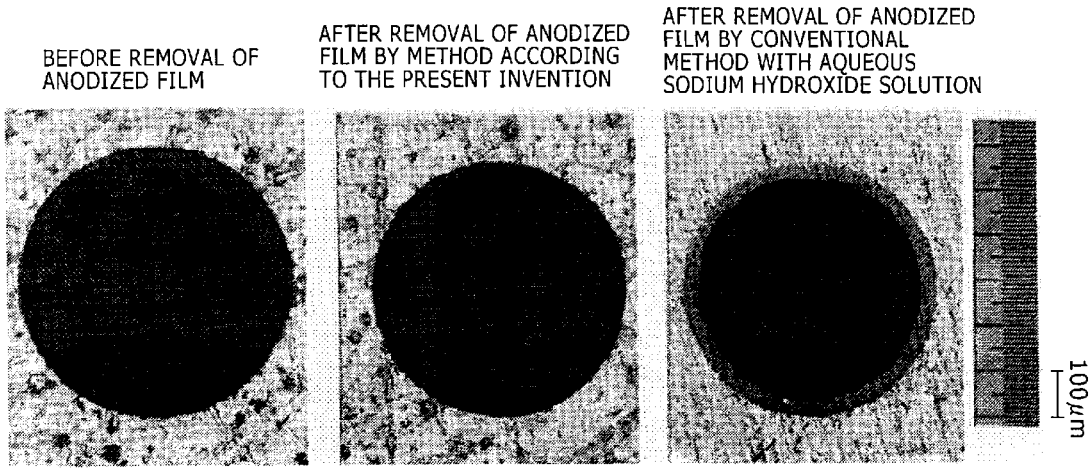
FIGS. 2A, 2B, and 2C are photographs each showing the removal of an anodized film on a hole of an aluminum alloy shower plate before and after treatment with removers.

FIG. 2A is a photograph showing a plan view of a hole of the shower plate before treatment with the remover. The hole has an anodized film about 30 μm thick inside thereof. FIG. 2B is a photograph showing a plan view of a hole of the shower plate after treatment with the remover according to the present invention (Remover 2). FIG. 2C is a photograph showing a plan view of a hole of the shower plate after treatment with a conventional aqueous sodium hydroxide (NaOH) solution (Remover 3). A comparison between FIG. 2A and FIG. 2B shows that Remover 2 according to the present invention selectively removes the anodized film, as the hole of the shower plate does not substantially change in its diameter. In contrast, a comparison between FIG. 2A and FIG. 2C shows that the conventional remover (Remover 3) dissolves and removes the underlying aluminum alloy, although it can remove the anodized film sufficiently, as the hole of the shower plate has a diameter about 30 μm larger than that before the treatment.

Test Example 3

An anodized film 10 μm thick was formed on a JIS 6061 aluminum alloy 20 mm wide, 60 mm long, and 4 mm thick using a sulfuric acid-containing treatment liquid, and the aluminum alloy was subjected to pore sealing and thereby yielded a test piece. A surface protector SPV-224 (Nitto Denko Corporation) was applied to the test piece, was left stand for six months, and was peeled off therefrom. Thus, a simulated test piece attached with an adhesive component imitating contaminants was prepared.

The simulated test piece attached with an adhesive component was immersed in Remover 1 described in Test Example 1 for thirty minutes. The test piece was taken out from the remover, was washed with water, was immersed in a 200 g/l aqueous nitric acid solution containing 5 g/l of a fluorine ion for one minute, was washed with water, and was dried. In this procedure, most of the surface of the test piece became white but some portions became metallic silver (non-uniformities).

Next, the test piece showing non-uniformities was subjected to airblasting. The blasting was conducted using WA-400 particles (alumina particles; Fujimi Incorporated) having a maximum particle diameter of 75 μm and a particle diameter at 50% of accumulated height of 30.9±2.0 μm at an air pressure of 0.4 MPa, a distance between the test piece and the blasting part of 100 mm for a blasting time of four seconds. The test piece was then immersed in a 10 percent by weight aqueous sodium hydroxide solution at 50° C. for two minutes, was washed with water for two minutes, and was further immersed in a 20 percent by weight aqueous nitric acid solution for two minutes. The test piece taken out from the solution was white as a whole without visible silver portions.

Test Example 4

An anodized film 10 μm thick was formed on a JIS 6063 aluminum alloy 20 mm wide, 60 mm long, and 4 mm thick using a sulfuric acid-containing treatment liquid, and the aluminum alloy was subjected to pore sealing and thereby yielded a test piece. A surface protector SPV-224 (Nitto Denko Corporation) was applied to the test piece, was left stand for six months, and was peeled off therefrom. Thus, a simulated test piece attached with an adhesive component imitating contaminants was prepared.

The simulated test piece attached with an adhesive component was immersed in an aqueous solution of 3 percent by weight hydrogen peroxide and 5 percent by weight aqueous sodium carbonate solution at 50° C. for sixty minutes, was washed with water, and was immersed in Remover 1 described in Test Example 1 for thirty minutes. The test piece was taken out from the remover, was washed with water, was immersed in a 200 g/l aqueous nitric acid solution containing 5 g/l of a fluorine ion for one minute, was washed with water, and was dried. The resulting test piece showed no non-uniformities.

As is described above, the present invention can be advantageously applied to the removal of anodized films of aluminum or aluminum-alloy members.

While the present invention has been described with reference to what are presently considered to be the preferred embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A method for removing an anodized film from an aluminum or aluminum-alloy member, comprising:

immersing the anodized aluminum or aluminum-alloy member in a remover for removing the anodized film, wherein the remover comprises:

(1) an alkaline component, (2) a bivalent zinc ion, (3) a ferric ion, (4) a chelating agent, and (5) a nitrate ion;

and subsequently immersing the member in a 100 g/l to 360 g/l aqueous nitric acid solution containing 2 g/l to 24 g/l of a fluorine ion.

2. The method for removing an anodized film from an aluminum or aluminum-alloy member of claim 1, wherein the alkaline component in the remover is selected from the group consisting of potassium hydroxide and sodium hydroxide; the bivalent zinc ion is added in the form selected from the group consisting of zinc chloride, zinc oxide, and zinc sulfate; the chelating agent is selected from the group consisting of tartaric acid, citric acid, gluconic acid, malic acid, and metal salts thereof; and the nitrate ion is added in the form selected from the group consisting of potassium nitrate and sodium nitrate.

3. The method for removing an anodized film from an aluminum or aluminum-alloy member according to claim 1, wherein the chelating agent in the remover has a carboxyl group.

4. A method for removing an anodized film of claim 1, wherein the remover further comprises 500 ppm to 5,000 ppm of a secondary amine.

5. The remover of claim 4, wherein the secondary amine is selected from the group consisting of dibutylamine, diethylamine, and diethanolamine.

6. A method for removing an anodized film, comprising:

immersing an anodized aluminum or aluminum-alloy member in the remover for removing an anodized film, wherein the remover comprises:

(1) an alkaline component, (2) a bivalent zinc ion, (3) a ferric ion, (4) a chelating agent, and (5) a nitrate ion;

subsequently immersing the member in a 100 g/l to 360 g/l aqueous nitric acid solution containing 2 g/l to 24 g/l of a fluorine ion;

bringing fine hard particles into collision with the surface of the member; and subsequently immersing the member in an etching solution.

7. A method for removing an anodized film of claim 6, wherein the remover the remover further comprises 500 ppm to 5,000 ppm of a secondary amine.

8. The method of claim 6, wherein bringing fine hard particles into collision with the surface of the member is carried out by air blasting or shot blasting the surface of the member.

9. The method of claim 7, wherein bringing fine hard particles into collision with the surface of the member is carried out by air blasting or shot blasting the surface of the member.

10. The method of claim 1, further comprising removing contaminants from the surface of the anodized aluminum or aluminum-alloy member before immersing the member in the remover.

11. The method of claim 4, further comprising removing contaminants from the surface of the anodized aluminum or aluminum-alloy member before immersing the member in the remover.

12. A method for removing an anodized film, comprising:

immersing an anodized aluminum or aluminum-alloy member in the remover for removing an anodized film from an aluminum or aluminum-alloy member, consisting essentially of:

(1) 10 g/l to 100 g/l of an alkaline component in terms of hydroxide ion concentration;

(2) 2 g/l to 20 g/l of a bivalent zinc ion, (3) 0.1 g/l to 1 g/l of a ferric ion, (4) a chelating agent in a concentration sufficient to prevent the formation of iron hydroxide, and (5) 0.3 g/l to 3 g/l of a nitrate ion;

and subsequently immersing the member in a 100 g/l to 360 g/l aqueous nitric acid solution containing 2 g/l to 24 g/l of a fluorine ion.

13. The method for removing an anodized film of claim 12, wherein the remover further comprises 500 ppm to 5,000 ppm of a secondary amine.

14. The method for removing an anodized film of claim 1, wherein the chelating agent in the remover is a hydroxycarboxylic acid having both a carboxyl group and a hydroxyl group in the molecule.

15. The method for removing an anodized film of claim 1, wherein the ferric ion in the remover is added in the form of ferric chloride hexahydrate.

16. The method for removing an anodized film of claim 1, wherein the alkaline component in the remover is selected from the group consisting of potassium hydroxide and sodium hydroxide and the remover has a concentration of the alkaline component of 25 g/l to 75 g/l in terms of hydroxide ion concentration.

17. The method for removing an anodized film of claim 1, wherein the bivalent zinc ion in the remover is added in the form selected from the group consisting of zinc chloride, zinc oxide, and zinc sulfate and to a bivalent zinc ion concentration of 4 g/l to 10 g/l.

18. The method for removing an anodized film of claim 1, wherein the chelating agent in the remover is selected from the group consisting of tartaric acid, citric acid, gluconic acid, malic acid, and metal salts thereof.

19. The method for removing an anodized film of claim 1, wherein the nitrate ion in the remover is added in the form selected from the group consisting of potassium nitrate and sodium nitrate.

* * * * *